US006368185B1

(12) United States Patent
Glenville

(10) Patent No.: US 6,368,185 B1
(45) Date of Patent: Apr. 9, 2002

(54) APPARATUS FOR MACHINING WORKPIECES

(75) Inventor: Reginald Paul Glenville, Preston (GB)

(73) Assignee: British Nuclear Fuels PLC, Warrington (GB)

( * ) Notice: Subject to any disclaimer, the term of this patent is extended or adjusted under 35 U.S.C. 154(b) by 0 days.

(21) Appl. No.: 09/509,351

(22) PCT Filed: Oct. 8, 1998

(86) PCT No.: PCT/GB98/03030

§ 371 Date: Jul. 13, 2000

§ 102(e) Date: Jul. 13, 2000

(87) PCT Pub. No.: WO99/19114

PCT Pub. Date: Apr. 22, 1999

(30) Foreign Application Priority Data

Oct. 11, 1997 (GB) ..... 9721511

(51) Int. Cl.[7] ..... B24B 49/00
(52) U.S. Cl. ..... 451/9; 33/558; 33/645
(58) Field of Search ..... 451/9, 8, 22, 397, 451/442, 1; 33/558, 645

(56) References Cited

U.S. PATENT DOCUMENTS 4,167,081 A 9/1979 Marmo

FOREIGN PATENT DOCUMENTS

DE 31 16 140 A 11/1982

*Primary Examiner*—Robert A. Rose
(74) *Attorney, Agent, or Firm*—Workman, Nydegger & Seeley

(57) ABSTRACT

A centerless grinding machine having a control wheel and a grinding wheel for machining cylindrical workpieces is adjusted prior to a machining operation using a setting component having the same diameter as the workpiece. The setting component is used so as to ensure that a surface of the control wheel is aligned with a guide surface of an outlet guide so as to facilitate accurate machining. Relative movement of the control wheel and the outlet guide enables an electrically conducting portion of the setting component to complete an electrical circuit when the two surfaces are in alignment. A current meter is activated when alignment is achieved. The setting component enables the machine to be adjusted at a remote location. The machine may therefore be located within a shielded enclosure for machining nuclear fuel pellets.

15 Claims, 2 Drawing Sheets

APPARATUS FOR MACHINING WORKPIECES

BACKGROUND OF THE INVENTION

1. Field of the Invention

The present invention relates to apparatus for performing a machining operation on a workpiece and, more particularly, to a means for setting up the apparatus prior to performing a machining operation.

The invention has particular application to the setting up of a centreless grinding machine to be used for the machining of nuclear fuel pellets.

2. Present State of the Art

In a typical centreless grinding machine a cylindrical workpiece is supported on an inclined work rest which is located between the peripheral surfaces of a control (or regulating) wheel and a grinding wheel. During the grinding operation the grinding wheel forces the workpiece downward against the work rest and also against the control wheel. To guide the finished machined workpiece from the control and grinding wheels, au outlet guide is positioned adjacent to the control wheel.

It is essential that the peripheral surface of the control wheel is aligned accurately with the outlet guide so that the machined workpiece is directed from the wheels in a straight lines. Misalignment of the control wheel surface and the outlet guide would result in the production of defectively machined products. Normally, this setting up procedure is done manually by an operative manipulating a typical workpiece across the interface between the control wheel and the outlet guide Simultaneously, the operative causes relative movement between the control wheel and the outlet guide and senses when the two are in alignment.

In certain situations it is difficult to set up the machine prior to a machining operation because of the restricted access to the various parts of the machine. One such situation concerns the use of centreless grinding machines for grinding nuclear pellets to the required diameter. Since the handling and machining of nuclear fuel pellets constitutes a health hazards it is necessary for safety reasons to locate the grinding machine in a protective enclosure. Thin presents problems when carrying out the setting up procedure.

OBJECTS AND BRIEF SUMMARY OF THE INVENTION

It is an object of this invention to provide a means for facilitating the setting up of an apparatus for machining a workpiece.

According to a first aspect of the invention there is provided apparatus for performing a machining operation on a workpiece, the apparatus comprising a control member having a first surface for locating a workpiece during a machining operation, an outlet guide having a second surface for guiding a workpiece away from the control member, the control member and the outlet guide being movable relative to one another to enable alignment of the first and second surfaces, an electrical circuit including an indicating means, and a setting component comprising an electrically conducting portion for use in aligning the first and second surfaces prior to machining a workpiece, wherein relative movement of the control member and the outlet guide enables the electrically conducting portion of the component to complete the electrical circuit and thereby activate the indicating means when the first and second surfaces are in alignment.

The electrical circuit preferably includes the second surface and relative movement of the control member and outlet guide enables the electrically conducting portion to contact the second surface whereby to complete the electrical circuit.

Preferably the apparatus is adapted to produce cylindrical workpieces by the machining operation, the setting component being in the form of a cylinder having substantially the same diameter as a workpiece to be machined.

The setting component preferably comprises an electrically insulating portion and an electrically conducting portion.

In a preferred embodiment the electrically insulating portion and the electrically conducting portion are each in the form of a semi-cylinder.

Alternatively, the setting component may be formed wholly from an electrically conducting material.

Preferably the control member comprises a rotatable control wheel, the said first surface thereof being adapted to impart a rotatable drive to a workpiece.

The apparatus may further comprise a grinding wheel arranged for rotation about an axis extending in parallel relationship to an axis of rotation of the control wheel, the grinding wheel having a peripheral surface formed with an abrasive material for effecting the machining operation on a workpiece.

A workpiece support preferably extends between the first surface of the control wheel and the peripheral surface of the grinding wheel, the setting component being so arranged that the electrically insulating portion thereof contacts the workpiece support.

Adjustment means may be provided for moving the control wheel in a direction perpendicular to the axis of rotation thereof whereby to obtain relative movement of the first and second surfaces.

Alternatively, adjustment means may be provided for moving the outlet guide whereby to obtain relative movement of the first and second surfaces.

Preferably the indicating means comprises a visual indicator.

The indicating means may comprise a current meter or may be adapted to provide an audible signal, According to a second aspect of the invention there is provided a method of setting up an apparatus for performing a machining operation on a workpiece, the apparatus comprising a control member having a first surface for locating a workpiece during a machining operation, an outlet guide having a second surface for guiding a workpiece away from the control member, an electrical circuit including an indicating means, and a setting component having an electrically conducting portion for use in aligning the first and second surfaces prior to machining the workpiece, the method comprising placing the setting component in contact with the first surface, causing relative movement of the control member and the outlet guide so as to allow the electrical conducting portion of the setting component to contact the second surface and thereby complete the electrical circuit, thereby activating the indicating means.

BRIEF DESCRIPTION OF THE DRAWINGS

Embodiments of the invention will now be described, by way of example, with reference to the accompanying drawings, in which.

DETAILED DESCRIPTION OF THE PREFERRED EMBODIMENT

Figure 2:
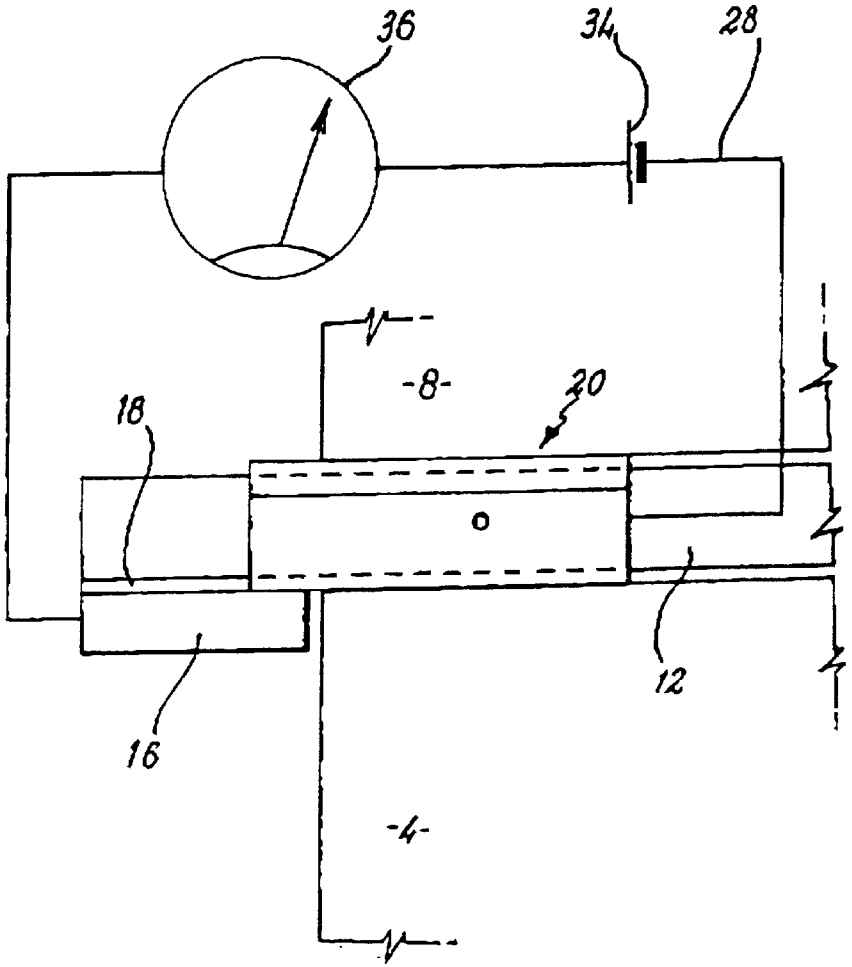
FIG. 2 is a plan view of the region of the apparatus shown in FIG. 1, and FIGS. 3 and 4 show, respectively, an end view and elevation of the setting component shown in FIGS. 1 and 2.
Figure 1:
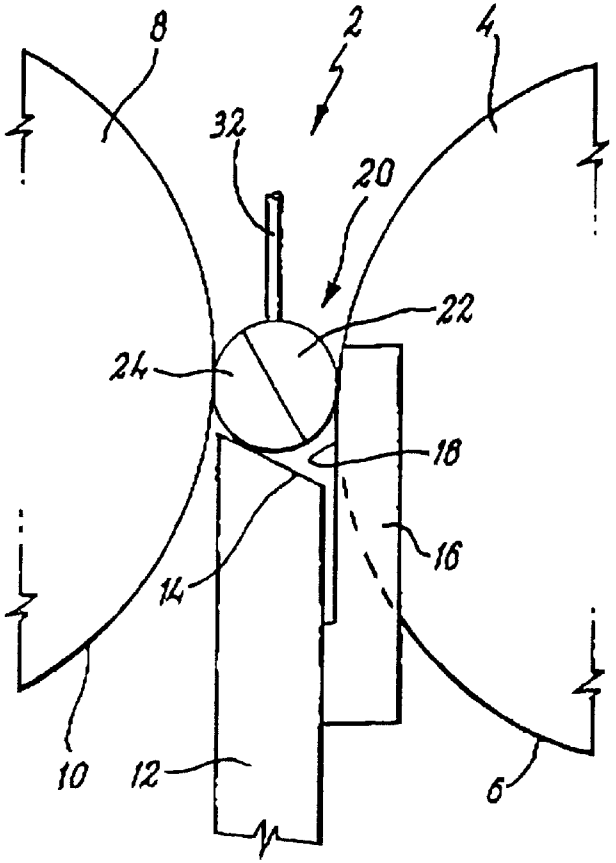
FIG. 1 is au end elevation of a region of an apparatus for machining a workpiece incorporating a setting component according to one aspect of the invention.

Referring to FIGS. 1 and 2, a region of an apparatus 2 for machining cylindrical workpieces is shown during a setting up procedure prior to a workpiece machining operation. The apparatus 2 is a centreless grinding machine used to grind workpieces in the form of nuclear fuel pellets and is therefore, for safety reasons, housed in a shielded enclosure, such as a glovebox (not shown). Workpieces are rotatable driven by a control wheel 4 having a peripheral surface 6 provided with a frictional driving medium, such as a rubber bonded abrasive material. A grinding wheel 8 for machining the workpieces has a peripheral surface 10 formed with a metal bonded abrasive material, the surface 10 extending in parallel relationship with the control wheel surface 6. Extending between the peripheral surfaces 6, 10 of the control wheel 4 and the grinding wheel 8 is a workpiece support 12. Workpieces to be machined by the grinding wheel 8 rest on an inclined surface 14 formed on the support 12, the surface 14 being inclined downwardly in a direction towards the control wheel 4.

An outlet guide 16 for receiving finished machined workpieces is attached to one end of the support 12 at a location adjacent to an end face of the control wheel 4. The outlet guide 16 has a vertical guide surface 18 which, as viewed in FIG. 2, forms a tangent with respect to the peripheral surface 6 of the control wheel 4, Thus the guide :face 18 extends in alignment with the control wheel surface 6, as viewed in FIG. 2, so as to guide the machined workpieces in a straight line from the control wheel 4.

In a preferred embodiment the apparatus 2 is a centerless grinding machine of the through feed type. Cylindrical workpieces to be ground are given an axial movement by the control wheel 4 and pass between this wheel and the grinding wheel e from ore side to the other along the support 12 towards the outlet guide 16. The grinding wheel 8 forces the workpiece downwards against the support 12 and also against the control wheel 4. The latter imparts a uniform rotation to the workpiece, the workpiece having the same peripheral speed as the control wheel 4. The axial rate of feed of the workpiece along the support 12 depends on the diameter, speed and inclination of the control wheel 4.

Figure 4:
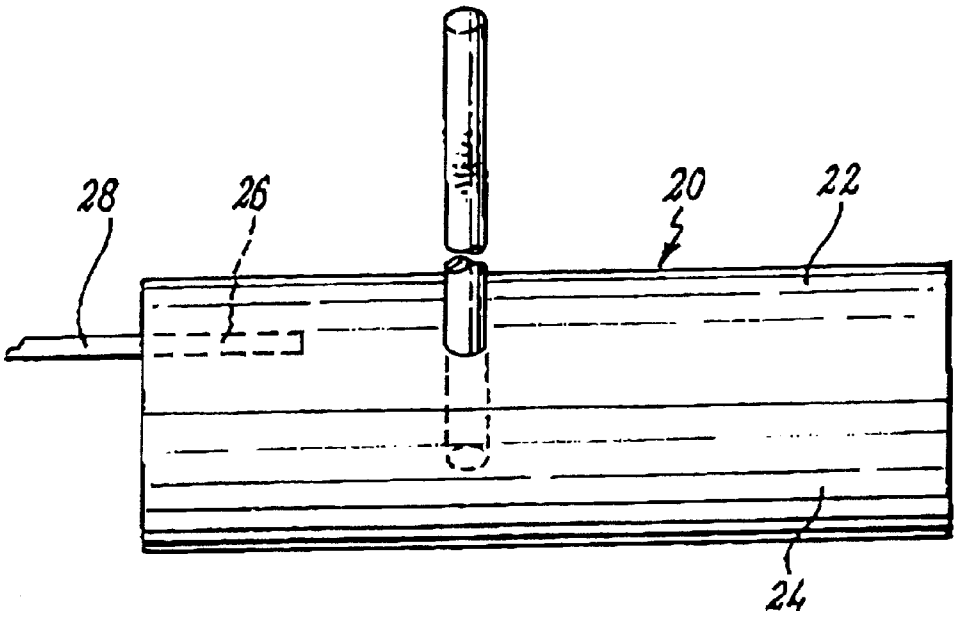
Figure 3:
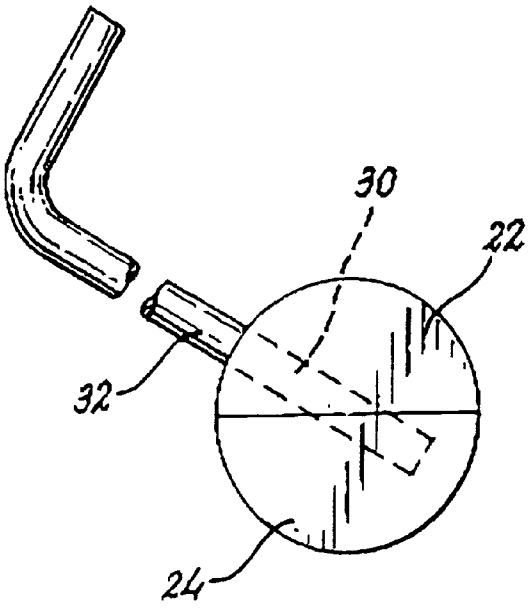

It is essential for achieving satisfactory machining of a workpiece that the guide surface 18 of the outlet guide 16 is in alignment with the peripheral surface 6 of the control wheel 4. If the guide surface 18 at its notional point of tangency with the peripheral surface 6 is too far to the left or right of the peripheral surface 6, as viewed in FIG. 1, this will result in the production of defective workpieces. In the present invention accurate alignment is achieved by using a dummy workpiece in the form of a setting component 20, which is illustrated in FIGS. 3 and 4.

The setting component 20 is in the form of a right cylinder having the same diameter as the workpiece to be ground and comprises two semi-cylindrical portions 22, 24 of different materials. The semi-cylindrical portion 22 is made from an electrically conducting material, for example, stainless steel, and the other semi-cylindrical portion 24 is made from an electrically insulating material, which may be a plastics material. A blind hole 26 is drilled into an end face of the conducting portion 22 of the setting component 20 for receiving an electrical wire 28. A further blind hole 30 is drilled into the peripheral surface of the conducting portion 22 along an axis which subtends an angle of 30 degrees with respect to the plane containing the junction of the two portions 22, 24. A rod handle 32 is received by the hole 30 which extends into the insulating portion 24.

As seen in FIG. 2, in use, an electrical circuit is formed by connecting the wire 28 to a power source 34, such as a battery, to a visual indicator, for example, a current meter 36, and to an electrical conducting portion of the outlet guide 16, Alternatively, the indicator may be replaced by a light source or an alarm capable of emitting an audible signal. Using a glove, not shown, forming part of the enclosure, the operative holds the rod handle 32 and positions the setting component 20 as shown in FIGS. 1 and 2. It will be appreciated that during the setting procedure, the grinding wheel a is retracted from the outlet guide 12. When the rod handle 32 is held vertically its position in the setting component 20 ensures that the insulating portion 24 is in contact with the inclined surface 14 of the support 12 The insulating portion 24 ensures that the electrical circuit is not completed through the support 12 and the outlet guide 16. Most of the length of the conducting portion 22 abuts against the peripheral surface 6 of the control wheel 4 and overlaps but does not contact the outlet guide 16. By means of an adjustment mechanism, the control wheel 4 is then moved away from the support 12 until the conducting portion 22 of the setting tool 20 touches the guide surface 18 of the outlet guide 16. This results in the completion of the electrical circuit, which is registered visually by the indicator 34, or by an audio signal. When this occurs, operation of the adjusting mechanism is stopped so as to fix the control wheel 4 in this position. It has been found that alignment of the control wheel peripheral surface 6 and the outlet guide surface 18 can be judged to within +/−0025 mm which is sufficiently accurate for grinding purposes. The adjustment mechanism for moving the control wheel 4 is similar to that conventionally used on centerless grinding machines, but is adapted to be controlled at a location outside the enclosure. After removal of the setting component 20, the grinding wheel a is moved into its machining position the control wheel 4 and the grinding wheel 8 are set in rotation and workpieces are machined by the grinding wheel as they pass along the support 12.

In an alternative embodiment, the setting component 20 is made wholly from an electrically conducting material. To prevent completion of the electrical circuit through the support 12, the support is made from an insulating material at least in the region which supports the setting component 20. The length of the insulation region is sufficient to extend beyond the face of the setting component 20 remote from the outlet guide 16. The setting up procedure is then carried out as described above.

In a further embodiment the outlet guide 16 is made adjustable rather than the control wheel 4. In this arrangement the setting component 20 is located against the peripheral surface 6 of the control wheel 4 and the outlet guide 16 is moved towards the grinding wheel 8. When the surface 18 contacts the conducting portion 22 of the setting component 20 the electrical circuit is completed and is visually indicated by the indicator 36, or by an audible signal. This indicates that the surfaces 18 and 6 are in alignment.

It will be appreciated that the invention is not restricted for use with centreless grinding machines to which access is limited, since the invention can be used with advantage for setting up machines where access is not a problem.

What is claimed is:

1. Apparatus for performing a machining operation on a workpiece, the apparatus comprising a control member having a first surface for locating a workpiece during a machining operation, an outlet glide having a second surface for guiding a workpiece away from the control member, the control member and the outlet guide being movable relative to one another to enable alignment of the first and second surfaces, an electrical circuit including an indicating means, and a setting component comprising an electrically conducting portion for use in aligning the first and second surfaces prior to machining a workpiece, wherein relative movement of the control member and the outlet guide enables the electrically conducting portion of the component to complete the electrical circuit and thereby activate the indicating means when the first and second surfaces are in alignment.

2. Apparatus according to claim 1, wherein the electrical circuit includes the second surface and the relative movement of the control member and outlet guide enables the electrically conducting portion to contact the second surface whereby to complete the electrical circuit.

3. Apparatus according to claim 1, wherein the apparatus is adapted to produce cylindrical workpieces by the machining operation, the setting component being in the form of a cylinder having substantially the same diameter as a workpiece to be machined.

4. Apparatus according to claim 1, wherein the setting component comprises an electrically insulating portion and an electrically conducting portion.

5. Apparatus accordingly to claim 3, wherein the electrically insulating portion and the electrically conducting portion are each in the form of a semi-cylinder.

6. Apparatus according to claim 1, wherein the setting component is formed wholly from an electrically conducting material.

7. Apparatus according to claim 1, wherein the control member comprises a rotatable wheel, the first surface thereof being adapted to impart a rotatable drive to a workpiece.

8. Apparatus according to claim 7, wherein the apparatus further comprises a grinding wheel arranged for rotation about an axis extending in parallel relationship to an axis of rotation of the control wheel, the grinding wheel having a peripheral surface formed with an abrasive material for effecting the machining operation on a workpiece.

9. Apparatus according to claim 8, wherein a workpiece support extends between the first surface of the control wheel and the peripheral surface of the grinding wheel and the setting component is so arranged that the electrically insulating portion thereof contacts the workpiece support.

10. Apparatus according to claim 7, wherein adjustment means are provided for moving the control wheel in a direction perpendicular to the axis of rotation thereof, whereby to obtain relative movement of the first and second surfaces.

11. Apparatus according to claim 1, wherein adjustment means are provided for moving the outlet guide whereby to obtain relative movement of the first and second surfaces.

12. Apparatus according to claim 1, wherein the indicating means comprises a visual indicator.

13. Apparatus according to claim 12, wherein the indicating means comprises a current meter.

14. Apparatus according to claim 12, wherein the indicating means is adapted to produce an audible signal.

15. A method of setting up an apparatus for performing a machining operation on a workpiece, the apparatus comprising a control member having a first surface for locating a workpiece during a machining operation, an outlet guide having a second surface for guiding a workpiece away from the control member; an electrical circuit including an indicating means, and a setting component comprising an electrically conducting portion for use in aligning the first and second surfaces prior to machining the workpiece, the method comprising placing the setting component in contact with the first surface, causing relative movement of the control member and the outlet guide so as to allow the electrically conducting portion of the setting component to contact the second surface and complete the electrical circuit, thereby activating the indicating means.

* * * * *

UNITED STATES PATENT AND TRADEMARK OFFICE

CERTIFICATE OF CORRECTION

PATENT NO. : 6,368,185 B1
DATED : April 9, 2002
INVENTOR(S) : Reginald Paul Glenville It is certified that error appears in the above-identified patent and that said Letters Patent is hereby corrected as shown below:

Column 1,
Line 27, before “Misalignment” change “lines.” to -- line. --
Line 32, after “guide” insert a period
Line 42, after “enclosure.” change “Thin” to -- This --

Column 2,
Line 65, before “end elevation” change “au” to -- an --

Column 3,
Line 14, after “Workpieces are” change “rotatable” to -- rotatably --
Line 32, after “wheel 4” change the comma to a period; and after “guide” change “:face” to -- surface --
Line 40, after “wheel” change “e” to -- 8 --; and before “side” change “ore” to -- one --

Column 4,
Line 10, after “guide 16” change the comma to a period
Lines 17 and 40, after “wheel” change “a” to -- 8 --
Line 20, after “support 12” insert a period
Line 35, after “within” change “+/-0025” to -- +/- 0.025 --

Column 5,
Line 5, after “outlet” change “glide” to -- guide --

Signed and Sealed this

Tenth Day of June, 2003

JAMES E. ROGAN
*Director of the United States Patent and Trademark Office*